US007086249B2

(12) United States Patent
Bae et al.

(10) Patent No.: US 7,086,249 B2
(45) Date of Patent: Aug. 8, 2006

(54) REFRIGERANT DISTRIBUTION DEVICE AND METHOD

(75) Inventors: Younglib Bae, Sicklerville, NJ (US); Michael E. Heidenreich, Olive Branch, MS (US)

(73) Assignee: Advanced Heat Transfer, LLC, Memphis, TN (US)

( * ) Notice: Subject to any disclaimer, the term of this patent is extended or adjusted under 35 U.S.C. 154(b) by 167 days.

(21) Appl. No.: 10/957,455

(22) Filed: Oct. 1, 2004

(65) Prior Publication Data

US 2006/0070401 A1 Apr. 6, 2006

(51) Int. Cl.
*F25B 39/02* (2006.01)
*F28F 9/02* (2006.01)

(52) U.S. Cl. ..... 62/504; 62/525; 165/173; 165/175

(58) Field of Classification Search ..... 62/199, 62/335, 504, 524, 525; 165/173, 175
See application file for complete search history.

(56) References Cited

U.S. PATENT DOCUMENTS 3,828,570 A * 8/1974 Stutz ..... 62/282
5,448,899 A 9/1995 Ohara et al.
5,651,268 A 7/1997 Aikawa et al.
5,910,167 A * 6/1999 Reinke et al. ..... 62/525
6,449,979 B1 9/2002 Nagasawa et al.
6,973,805 B1 * 12/2005 Higashiyama ..... 62/525
2004/0262560 A1 12/2004 Trumbower et al.
2006/0032268 A1 2/2006 Cole et al.

FOREIGN PATENT DOCUMENTS

EP 1 548 380 A2 6/2005
GB 2 366 359 A 5/2001

* cited by examiner

*Primary Examiner*—Marc Norman
(74) *Attorney, Agent, or Firm*—Brooks Kushman P.C.

(57) ABSTRACT

A refrigerant distribution device 10 situated in an inlet header 12 of a multiple tube heat exchanger 14 of a refrigeration system 20. The device 10 includes an inlet passage 32 that is in communication with an expansion device. Small diameter nozzles 34 are disposed within the inlet header 12 and are in fluid communication with the inlet passage 32. Capillary liquid nozzles 36 also lie within the inlet header 12 and are in fluid communication with the inlet passage 32. A two-phase refrigerant fluid in the inlet passage 32 has a refrigerant liquid-vapor interface 38. The vapor nozzles 34 have vapor inlet ports 40 that lie above the refrigerant liquid-vapor interface 38. The capillary liquid nozzles 36 have liquid inlet ports 42 that lie below the refrigerant liquid-vapor interface 38. Vapor emerging from the vapor nozzles 34 blow onto and atomize liquid emerging from the liquid nozzle to create a homogeneous refrigerant that is uniformly delivered to the multiple tubes. The invention also includes a method for delivering a uniform distribution of a homogeneous liquid mixture of liquid and vaporous refrigerant through the heat exchanger tubes.

8 Claims, 2 Drawing Sheets

REFRIGERANT DISTRIBUTION DEVICE AND METHOD

BACKGROUND OF THE INVENTION

1. Field of the Invention

The present invention relates to a refrigerant distribution device and method for use in a refrigeration system having a compressor, condenser, expansion device, and an evaporator.

2. Background Art

In a typical air conditioning system, high-pressure liquid refrigerant from a condenser enters an expansion device where pressure is reduced. The refrigerant at the exit of the expansion device consists of a mixture of low-pressure refrigerant liquid and vapor. This mixture enters an evaporator where more of the liquid becomes vapor while the refrigerant absorbs energy from the heat exchanger as it cools the air to the conditioned space. In evaporator heat exchangers that are constructed of multiple parallel heat transfer tubes, the incoming refrigerant liquid-vapor mixture typically enters a common manifold that feeds multiple tubes simultaneously.

Due to gravity and momentum effects, the liquid refrigerant separates from the vapor refrigerant and stays at the bottom of the tube. The liquid refrigerant will proceed to the end of the manifold and feed more liquid refrigerant into the tubes at the manifold end than the tubes adjacent the inlet tube to the manifold. This results in uneven feeding of refrigerant into the heat transfer tubes of the heat exchanger, causing less than optimal utilization of the evaporator heat exchanger.

As the liquid refrigerant absorbs heat it boils or evaporates. If some tubes have less liquid refrigerant flowing through them to boil, some parts of the heat exchanger may be under utilized if all of the liquid refrigerant boils well before the exit of the heat transfer tubes.

As the refrigerant evaporator delivers cold air, it is desirable that the temperature distribution in the emergent air flow be relatively uniform. This goal is complicated by the fact that numerous refrigerant passages may deliver non-uniform cold air.

It is known that other things being equal, a vapor phase flows in a refrigerant passage along the upper space in a horizontally oriented refrigerant distribution pipe. The liquid phase typically flows in a refrigerant passage along the lower volume of the refrigerant distribution pipe. In this way, refrigerant flow conventionally is separated. This phenomenon has complicated the task of distributing refrigerant fluid uniformly inside and along the several refrigerant passages of a refrigerant distribution system.

Another complicating factor is that the more remote the refrigerant is from an inlet side of a system including several refrigerant evaporation passages, the more difficult it is for the liquid refrigerant to flow uniformly. Conversely, the closer the refrigerant is to the inlet side, the more difficult it is for the liquid refrigerant to flow. As a result, the cooling characteristics of air passing around the refrigerant evaporation passage proximate the inlet side and that passing around distal refrigerant evaporation passages is unequal. Consequently, temperature of air passing around the refrigerant evaporation passage at the inlet side differs from that surrounding the distal refrigerant evaporation passages. This phenomenon tends to cause an uneven distribution of temperature in the emergent cold air.

A prior art search revealed the following references: U.S. Pat. No. 6,449,979; U.S. Pat. No. 5,651,268; U.S. Pat. No. 5,448,899; GB 2 366 359, the disclosures of which are incorporated here by reference.

The '979 patent mostly deals with refrigerant distribution in automotive evaporators. The idea is to control the refrigerant flow down the manifold by employing a series of progressively smaller holes. See, e.g., FIGS. 1 & 2.

The '268 patent discloses an apparatus for improving refrigerant distribution in automotive evaporators. The fundamental concept is to mix the refrigerant liquid and vapor at the evaporator inlet and control the distribution of the tubes through small holes that are located around the inlet tube. See, e.g., FIGS. 9 & 12.

The '899 patent discloses a system which separates the liquid refrigerant from the vapor at the evaporator inlet through gravity. Vapor is channeled to the evaporator outlet and only liquid refrigerant is allowed to proceed through the heat exchanger. One limitation of this approach is that the heat exchanger orientations be such that gravity separates the liquid and vapor. Additionally, this approach is most suitable for plate-type evaporators and may not function effectively in other types of evaporators.

GB 2 366 359 teaches an arrangement of four heat exchanger sections which controls refrigerant flow such that it balances the refrigerant heat transfer. However, there is a non-uniform refrigerant distribution in each section which impedes efficient utilization of the heat exchanger.

SUMMARY OF THE INVENTION

One object of the invention is to provide the heat transfer tubes with a homogeneous mixture of liquid and vapor refrigerant which will provide uniform feeding of refrigerant. The result will be uniform utilization of the evaporator heat exchanger.

The invention encompasses a refrigerant distribution device that is located in an inlet header of a multiple tube heat exchanger of a refrigeration system. Conventionally, the system has an expansion device means that delivers a two-phase refrigerant fluid to the inlet header. The multiple tube heat exchanger also has an outlet header that delivers a refrigerant fluid that is substantially in a vapor state. A plurality of tubes lie in fluid communication between the inlet and outlet headers.

The refrigerant distribution device includes an inlet passage that extends substantially along and within the inlet header. The inlet passage is in communication with the evaporator.

One or more small diameter (up to 5 mm in diameter; preferably up to 1.5 mm in diameter, depending on flow rate and size of the heat exchanger) nozzles are disposed within the inlet header that are in fluid communication with the inlet passage. Concomitantly, one or more capillary liquid nozzles are also provided within the inlet header and in fluid communication with the inlet passage.

The two-phase refrigerant fluid in the inlet passage has a refrigerant liquid-vapor interface below which the fluid is predominantly in the liquid phase and above which the fluid is predominantly in the vapor phase.

Each small diameter nozzle has a vapor inlet port that lies above the refrigerant liquid-vapor interface. Each capillary liquid nozzle has a liquid inlet port below the refrigerant liquid-vapor interface. Refrigerant flow into the inlet tube and a pressure difference between the inlet tube and the outlet header urge a liquid flow through the capillary liquid nozzles and a vapor flow through the small diameter nozzles. The vapor impinges upon liquid flow to create homogeneous mixture of liquid and vaporous refrigerant to be delivered relatively uniformly through the plurality of tubes for efficient distribution of the refrigerant fluid.

The invention also encompasses a method for distributing a homogeneous mixture of liquid and vaporous refrigerant to the plurality of tubes using the disclosed refrigerant distribution device.

DETAILED DESCRIPTION OF THE PREFERRED EMBODIMENT(S)

Figure 1:
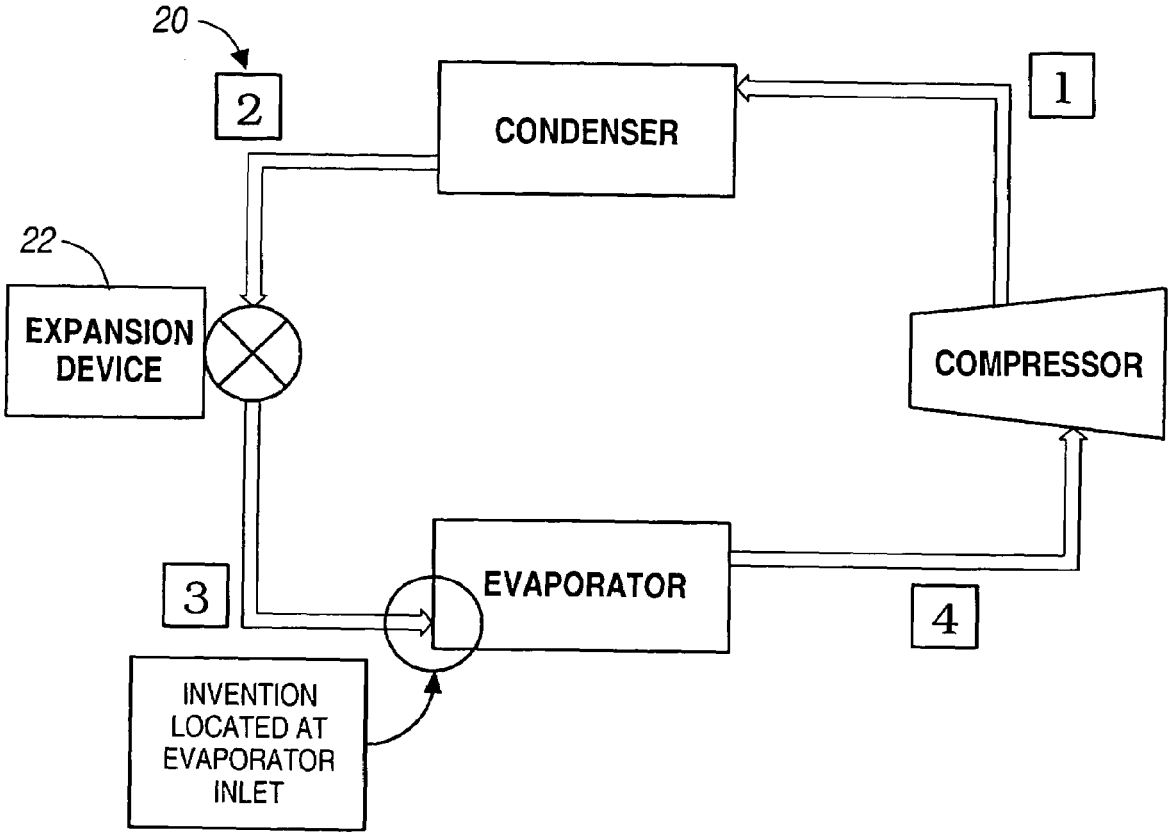
FIG. 1 is a schematic illustration of the main components of a conventional refrigeration system and shows where the invention is situated.

Turning first to FIG. 1, there are depicted the major components of a conventional refrigeration system. This figure is useful in illustrating the positioning of the invention in relation to conventional components. It will be appreciated that the term "refrigeration cycle" is a generic term which describes a vapor compression cycle that is used in both air conditioning and low temperature refrigeration systems.

In FIG. 1, the compressor adds energy to a refrigerant by compressing it to a high pressure. The refrigerant enters the condenser along passage (1) as a high temperature vapor. The condenser typically rejects energy to a heat sink—usually ambient air. Upon emergence from the condenser as a high pressure subcooled liquid (2), the refrigerant flows through an expansion (throttling) device. This device reduces the pressure of the refrigerant. On leaving the expansion device, the refrigerant exists in two phases: primarily liquid (about 80%); and some vapor (about 20%) in passage (3). This two-phase refrigerant then enters the evaporator. There, it absorbs energy and provides a cooling effect. In most cases, as the fluid evaporator continues to absorb energy, the refrigerant evaporates or boils. The system is designed to completely evaporate all of the refrigerant, providing low pressure superheated gas back to the compressor (4).

Usually, the fluid is being cooled by air. However, the coolant may also be a liquid—such as water.

Figure 2:
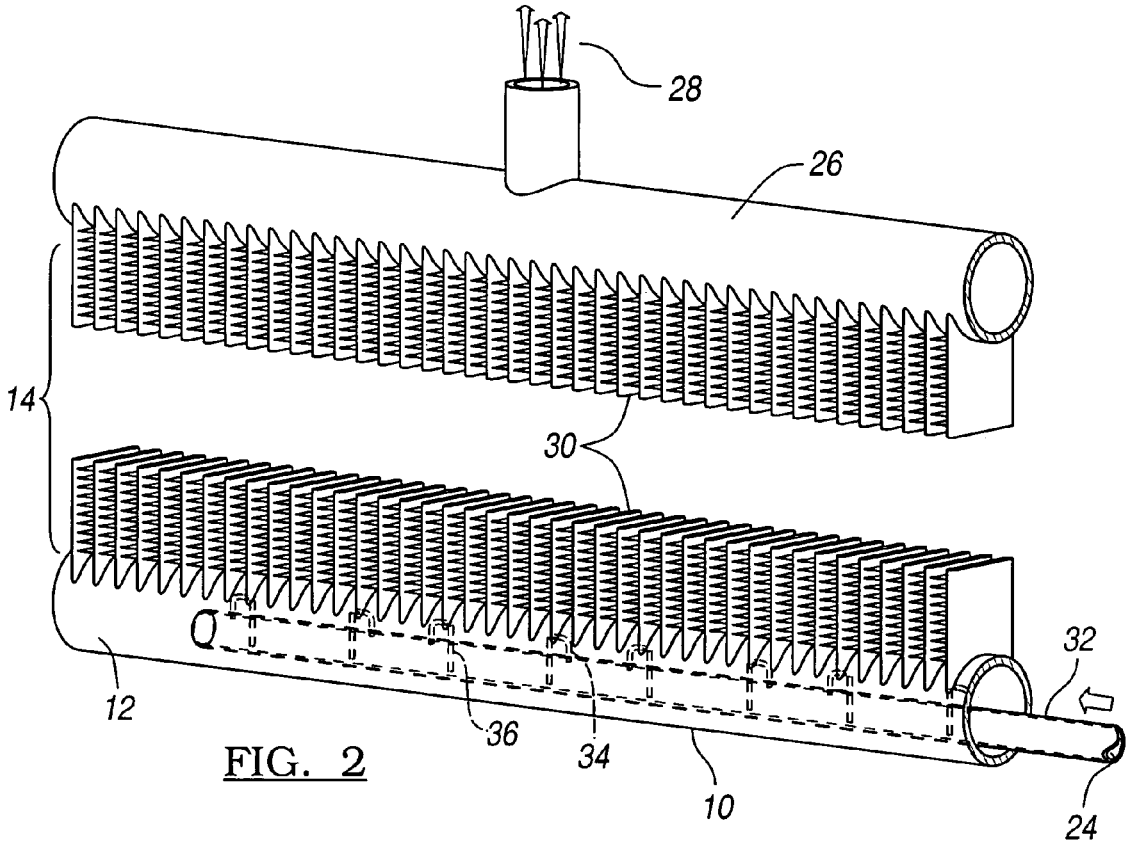
FIG. 2 is a sectioned partially cut away view of a multiple tube heat exchanger with an inlet header that houses the invention.
Figure 3:
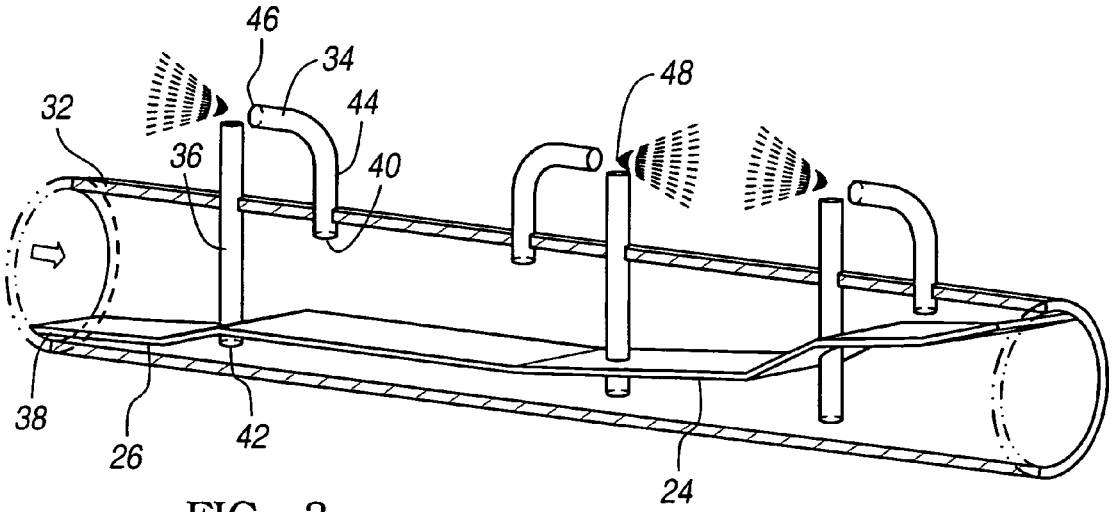
FIG. 3 is a cut away, quartering perspective view of the inlet header showing a desired position of the capillary liquid nozzles in relation to a refrigerant liquid-vapor interface.

In FIG. 1, the invention to be disclosed herein is located at the evaporator inlet. Turning now to FIGS. 1–3, there is depicted a refrigerant distribution device 10 in an inlet header 12 of a multiple tube heat exchanger 14 of a refrigeration system 20. Conventionally, the system has an expansion device means 22 (FIG. 1) that delivers a two-phase refrigerant fluid 24 (FIG. 3) to the inlet header 12. Typically, the multiple tube heat exchanger also has an outlet header 26 (FIG. 2) that delivers a cool refrigerant fluid 28 that is substantially in a vapor state. Although depicted as having a circular cross-section, either or both of the headers may have a cross-section that is elliptical or oval, and may or may not be symmetrical about an equatorial plane. As is known, a plurality of tubes 30 lie in fluid communication between the inlet and outlet headers 12, 26.

The refrigerant distribution device 10 includes an inlet passage 32 (FIGS. 2,3) that extends substantially along and within the inlet header 12. The inlet passage is in communication with the expansion device means 22. One or more small diameter nozzles 34 are disposed within the inlet header 12 that are in fluid communication with the inlet passage 32. Additionally, one or more capillary liquid nozzles 36 also lie within the inlet header 12 and are in fluid communication with the inlet passage 32.

The two-phase refrigerant fluid in the inlet passage 32 has a refrigerant liquid-vapor interface 38 (FIG. 3). Below the refrigerant liquid-vapor interface 38, the fluid is predominantly in a liquid phase. Above the refrigerant liquid-vapor interface 38, the fluid is predominantly in a vapor phase.

The one or more small diameter nozzles 34 have vapor inlet ports 40 that lie above the refrigerant liquid-vapor interface 38. The one or more capillary liquid nozzles 36 have liquid inlet ports 42 that lie below the refrigerant liquid-vapor interface 38.

Pressure exerted by refrigerant flow into the inlet passage 32 and a pressure difference between the inlet passage 32 and the outlet header 26 urge a liquid flow through the capillary liquid nozzles 36 and a vapor flow through the one or more small diameter nozzles 34. In this way, the vapor flow impinges upon the liquid flow to create an atomized homogeneous mixture of liquid and vaporous refrigerant to be delivered relatively uniformly via the inlet header 12 through the plurality of tubes 30 to the outlet header 26 for efficient distribution of the refrigerant fluid.

One or more small diameter nozzles 34 include an inlet section 44 that extends radially outwardly from the inlet passage 32 and an outlet section 46 connected to the inlet section 44. The outlet section 46 extends axially in relation to the inlet passage 32 for directing a vapor flow toward an outlet port 48 of an adjacent capillary liquid nozzle 36.

As shown in FIG. 2, there are multiple pairs of small diameter and liquid nozzles. Adjacent pairs have vapor nozzles that are oriented in opposite directions.

In FIG. 3, the refrigerant liquid-vapor interface 38 lies at an elevation that tends to rises with the distance away from an inlet port of the inlet passage 32.

The invention also encompasses a method for delivering a homogeneous mixture of liquid and vaporous refrigerant relatively uniformly through the multiple tubes of a heat exchanger 14 with an inlet header 12. The method comprises the steps of:

providing an inlet passage 32 within the inlet header 12, the inlet passage 32 being in communication with an expansion device means;

disposing one or more small diameter nozzles 34 within the inlet header 12 that are in fluid communication with the inlet passage 32;

locating one or more capillary liquid nozzles 34 also within the inlet header 12 in communication with the inlet passage 32;

delivering a two-phase refrigerant fluid to the inlet passage so that a refrigerant liquid-vapor interface 38 is created therein below which the fluid is predominantly in a liquid phase and above which the fluid is predominantly in a vapor phase;

situating one or more small diameter nozzles so that associated vapor inlet ports 40 lie above the refrigerant liquid-vapor interface;

submerging the one or more capillary liquid nozzles so that associated liquid inlet ports lie below the refrigerant liquid-vapor interface; and pressurizing refrigerant flow into the inlet passage so that a liquid flow is urged through the capillary liquid nozzles and a vapor flow through the vapor nozzles so that the vapor flow impinges upon the liquid flow to create a homogeneous mixture of liquid and vaporous refrigerant to be delivered relatively uniformly through multiple tubes to the outlet header for efficient distribution of the refrigerant fluid.

The pressure at the tip 48 of the capillary liquid 36 (FIG. 3) line is lower than elsewhere around the tip. Therefore, the liquid flow is drawn up and released into the header. Droplets will be dispersed in the vapor phase, thus enabling uniform delivery of refrigerant to the tubes.

It will be appreciated that conventionally the refrigerant inlet may be located toward either end of the inlet header 12 or intermediate therebetween. Depending on where it is located within the heat exchanger inlet header 12, some of the heat exchanger tubes 30 may receive all liquid, some are vapor, and some a mixture. Thus, the disclosed invention avoids what would otherwise be an ineffective use of the heat exchanger.

The definition of refrigerant in this disclosure includes any fluid/chemical where the fluid will be in liquid and vapor states when flowing through the evaporator. As the refrigerant absorbs energy, it continually boils (evaporates), eventually the entire volume of refrigerant becoming vapor. It is the changing of phases and the heat of vaporization which characterizes vapor compression refrigeration systems. There are hundreds of chemicals which can be classified as refrigerants, but the following lists the most common:

HCFC-22 (used in the large majority of air conditioning systems);

HFC-134a (used in automobile air conditioners, vending machines and home refrigerators);

HFC-404A (used in commercial refrigeration systems); and

HFC-410A (used in air conditions and is a designated replacement for HCFC-22).

HCFC is a hydrochlorofluorocarbon. A refrigerant fluid such as HCFC-22 is used in the majority of air conditioners today. HCFC-22 (R22) consists of chlorodifluoromethane. R22 is a single component HCFC refrigerant with a low ozone depletion potential. It is used for air conditioning and refrigeration applications in a variety of markets, including appliance, construction, food processing, and supermarkets. Freon® is a trade name for a group of chlorofluorocarbons used primarily as refrigerants. Freon® is a registered trademark belonging to E.I. du Ponte de Nemours & Company.

Typical temperatures and pressures with HCFC-22 at the 4 state points in the refrigeration cycle (FIG. 1) are:

1. 260 psig, 180° F., superheated vapor
2. 250 psig, 100° F., subcooled liquid
3. 81 psig, 48° F. two phase liquid & vapor
4. 75 psig, 60° F. superheated vapor.

Less common and/or future refrigerants are:

Carbon dioxide (a longer term replacement for many of the above refrigerants);

Ammonia (used in larger cold storage refrigeration systems);

Iso-butane and propane (used in small refrigeration systems in Europe); and

Water (can also be used as a two-phase refrigerant).

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A refrigerant distribution device in an inlet header of a multiple tube heat exchanger of a refrigeration system, the system having an expansion device means that delivers a two-phase refrigerant fluid to the inlet header, the multiple tube heat exchanger having an outlet header that delivers a cooled refrigerant fluid that is substantially in a vapor state and a plurality of tubes in fluid communication between the inlet and outlet headers;

the refrigerant distribution device including an inlet passage within the inlet header, the inlet passage being in communication with the expansion device means;

one or more small diameter nozzles within the inlet header in fluid communication with the inlet passage;

one or more capillary liquid nozzles also within the inlet header and in fluid communication with the inlet passage;

the two-phase refrigerant fluid in the inlet passage having a refrigerant liquid-vapor interface below which the fluid is predominantly in a liquid phase and above which the fluid is predominantly in a vapor phase;

the one or more small diameter nozzles having vapor inlet ports that lie above the refrigerant liquid-vapor interface;

the one or more capillary liquid nozzles having liquid inlet ports that lie below the refrigerant liquid-vapor interface;

refrigerant flow into the inlet passage and a pressure difference between the inlet passage and the outlet header forcing a liquid flow through the one or more capillary liquid nozzles and a vapor flow through the one or more small diameter nozzles so that the vapor flow impinges upon the liquid flow upon emergence from the nozzles to create a homogeneous mixture of refrigerant extending over substantially the entire length of the inlet header to be delivered relatively uniformly through the plurality of tubes to the outlet header for efficient distribution of the refrigerant fluid.

2. The refrigerant device of claim 1 wherein the one or more small diameter nozzles include an inlet section that extends radially outwardly from the inlet passage and an outlet section connected to the inlet section, the outlet section extending axially in relation to the inlet passage for directing a vapor flow toward an outlet port of an adjacent capillary liquid nozzle.

3. The refrigerant distribution device of claim 2 including multiple pairs of small diameter and liquid nozzles, wherein the outlet sections of adjacent pairs are oriented in opposite directions.

4. The refrigerant distribution device of claim 1 wherein the inlet passage extends substantially along and within the inlet header.

5. The refrigerant distribution device of claim 1 wherein the refrigerant liquid-vapor interface lies at an elevation that rises with the distance away from an inlet port of the inlet passage of the inlet header.

6. An inlet header of a multiple tube heat exchanger of a refrigeration system, the system having an expansion device means that delivers a two-phase refrigerant fluid to the inlet header, the multiple tube heat exchanger having an outlet header that delivers a cooled refrigerant fluid that is substantially in a vapor state and; a plurality of tubes in fluid communication between the inlet and outlet headers, the inlet header having a refrigerant distribution device including an inlet passage within the inlet header, the inlet passage being in communication with the expansion device means;

one or more small diameter nozzles within the inlet header in fluid communication with the inlet passage;

one or more capillary liquid nozzles also within the inlet header and in fluid communication with the inlet passage;

the two-phase refrigerant fluid in the inlet passage having a refrigerant liquid-vapor interface below which the fluid is predominantly in a liquid phase and above which the fluid is predominantly in a vapor phase;

the one or more small diameter nozzles having vapor inlet ports that lie above the refrigerant liquid-vapor interface;

the one or more capillary liquid nozzles having liquid inlet ports that lie below the refrigerant liquid-vapor interface;

refrigerant flow into the inlet passage and a pressure difference between the inlet passage and the outlet header forcing a liquid flow through the one or more capillary liquid nozzles and a vapor flow through the one or more small diameter nozzles so that the vapor flow impinges upon the liquid flow upon emergence from the nozzles to create a homogeneous mixture of refrigerant extending over substantially the entire length of the inlet header to be delivered relatively uniformly through the plurality of tubes to the outlet header for efficient distribution of the refrigerant fluid.

7. A multiple tube heat exchanger with a refrigerant distribution device in an inlet header of the heat exchanger, the multiple tube heat exchanger having an outlet header that delivers a cooled refrigerant fluid that is substantially in a vapor state and a plurality of tubes in fluid communication between the inlet and outlet headers, the refrigerant distribution device including an inlet passage within the inlet header, the inlet passage being in communication with the expansion device means;

one or more small diameter nozzles within the inlet header in fluid communication with the inlet passage;

one or more capillary liquid nozzles also within the inlet header and in fluid communication with the inlet passage;

the two-phase refrigerant fluid in the inlet passage having a refrigerant liquid-vapor interface below which the fluid is predominantly in a liquid phase and above which the fluid is predominantly in a vapor phase;

the one or more small diameter nozzles having vapor inlet ports that lie above the refrigerant liquid-vapor interface;

the one or more capillary liquid nozzles having liquid inlet ports that lie below the refrigerant liquid-vapor interface;

refrigerant flow into the inlet passage and a pressure difference between the inlet passage and the outlet header forcing a liquid flow through the one or more capillary liquid nozzles and a vapor flow through the one or more small diameter nozzles so that the vapor flow impinges upon the liquid flow upon emergence from the nozzles to create a homogeneous mixture of refrigerant extending over substantially the entire length of the inlet header to be delivered relatively uniformly through the plurality of tubes to the outlet header for efficient distribution of the refrigerant fluid.

8. A method for providing a homogeneous mixture of refrigerant to be delivered relatively uniformly through the tubes of a heat exchanger having an inlet header, the method comprising the steps of:

providing an inlet passage within the inlet header, the inlet passage being in communication with an expansion device means;

positioning one or more small diameter nozzles within the inlet header that are in fluid communication with the inlet passage;

locating one or more capillary liquid nozzles also within the inlet header in communication with the inlet passage;

delivering a two-phase refrigerant fluid to the inlet passage so that a refrigerant liquid-vapor interface is created therein below which the fluid is predominantly in a liquid phase and above which the fluid is predominantly in a vapor phase;

situating the one or more small diameter nozzles so that associated vapor inlet ports lie above the refrigerant liquid-vapor interface;

submerging the one or more capillary liquid nozzles so that associated liquid inlet ports lie below the refrigerant liquid-vapor interface; and pressurizing refrigerant flow into the inlet passage whereby a liquid flow is forced through the capillary liquid nozzles and a vapor flow through the vapor nozzles so that the vapor flow impinges upon the liquid flow to create a homogeneous refrigerant to be delivered relatively uniformly through the plurality of tubes to the outlet header for efficient distribution of the refrigerant fluid.

* * * * *